United States Patent [19]

Kutnyak

[11] Patent Number: 4,490,575

[45] Date of Patent: Dec. 25, 1984

[54] FLEXIBLE HOSE WITH EXTERNAL SHEATHED ELECTRICAL CONDUCTOR

[75] Inventor: Thomas A. Kutnyak, Greenwood, Conn.

[73] Assignee: Automation Industries, Inc., Greenwich, Conn.

[21] Appl. No.: 498,419

[22] Filed: May 26, 1983

[51] Int. Cl.[3] ..... A47L 9/24; F16L 11/12

[52] U.S. Cl. ..... 174/47; 138/129

[58] Field of Search ..... 174/47; 138/103, 129; 340/320; 361/215

[56] References Cited

U.S. PATENT DOCUMENTS 3,846,202 11/1974 Clarke ..... 138/129 X 4,224,463 9/1980 Koerber ..... 174/47

FOREIGN PATENT DOCUMENTS 2439966 3/1975 Fed. Rep. of Germany ..... 174/47

2518989 11/1976 Fed. Rep. of Germany ..... 174/47

*Primary Examiner*—Laramie E. Askin

*Attorney, Agent, or Firm*—Francis N. Carten

[57] ABSTRACT

A helically fabricated electrically conductive flexible hose having a self-supporting electrically conductive helical reinforcing element of non-circular cross-section with a flat side facing inwardly and defining the outermost element of the hose bonded to a flexible plastic hose wall.

5 Claims, 2 Drawing Figures

FLEXIBLE HOSE WITH EXTERNAL SHEATHED ELECTRICAL CONDUCTOR

BACKGROUND OF THE INVENTION

Helically fabricated electrically conductive flexible hose of the type commonly used for vacuum cleaners has been known to include a pair of conductor wires surrounded by a plastic sheath and with this composite element itself enclosed within an outer wall of overlapping turns of helically wrapped plastic strip, U.S. Pat. No. 4,167,645 and British Pat. No. 1,310,737 are examples of such constructions. In none of these electrically conductive hoses, however, is the sheathed pair of conductors applied about the outside of the helically wrapped strips which form the hose wall.

In other hose structure which do not conduct electricity and where one or more wires are used only for reinforcing purposes, it has been known to apply a sheathed wire about an innermost helically wrapped plastic strip, as for example in U.S. Pat. No. 4,304,266, but here too the sheathed wire is enclosed within an outer wall ply and does not form the outermost element of the structure. Longitudinal and circumferential reinforcing cords may be incorporated in these hose wall structures as taught in U.S. Pat. No. 4,224,463.

It is the principal purpose of the present invention to provide the most economical wire reinforced electrically conductive hose structure. This is achieved by forming a simple inner hose wall of overlapping convolutions of plastic strip, whether of single or multiple ply or reinforced with cords, and then helically applying a pair of sheathed wires about such a wall to form the outermost element of the structure.

SUMMARY OF THE INVENTION

The invention provides a helically fabricated electrically conductive flexible hose which includes at least one plastic strip wrapped helically with successive convolutions overlapping to form a flexible hose wall of at least one ply. At least one self-supporting electrically conductive helical reinforcing element forms the outermost element of the hose and is concentric with and engages the outside of the wall. This element is of composite construction comprising at least two spaced inner metal wires and an outer plastic sheath of non-circular cross-section enclosing the wires and having a substantially flat side facing inwardly and engaging the outer ply of the wall. The plastic sheath is bonded to the plastic wall. In a preferred form of the invention a separate plastic insulation layer surrounds each metal wire within the plastic sheath.

The external profile of the hose of the invention is sharply defined by the convolutions of the helical reinforcing element and the wall is otherwise light in weight and very flexible. By using a continuously advancing mandrel such as that disclosed in U.S. Pat. No. 3,155,559, the hose structure can be produced quickly with an easy machine setup and very little machine down time. The other convoluted sheath about the conductors also serves as a scuff strip which improves the abrasion resistance of the hose while the bore of the hose is notably smooth to provide good air flow properties. Other advantages of the invention will become apparent in the following description of a preferred embodiment in conjunction with the accompanying drawings.

DESCRIPTION OF PREFERRED EMBODIMENT

Figure 1:
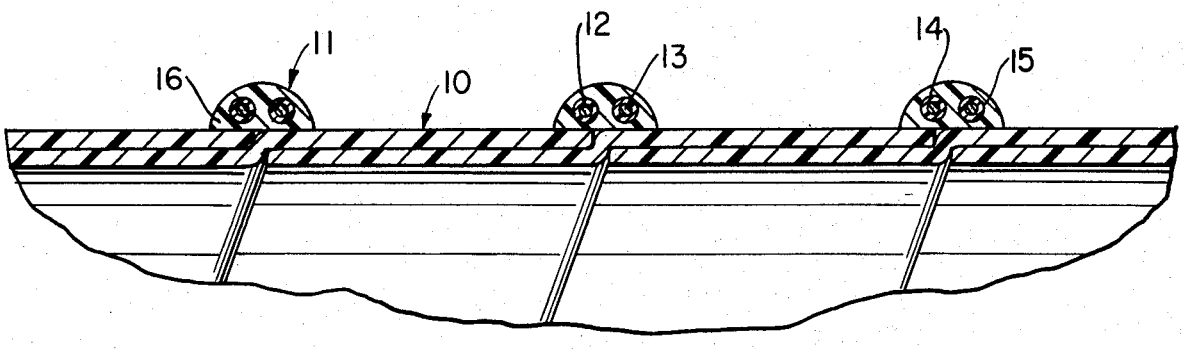
FIG. 1 is an enlarged fragmentary cross-section of the helically fabricated electrically conductive flexible hose of the invention.

Referring first to FIG. 1 a hot extruded plastic strip 10 of perhaps 0.010 to 0.020 inch thickness and a width of 0.500 inch is applied helically about a mandrel with successive convolutions overlapping. In this example almost half the width of the strip overlaps upon itself so that a two-ply wall is formed. The overlapping convolutions of the strip are bonded together with heat or solvent. Various thermoplastic materials may be used for the strip 10, such as polyvinylchloride, polyurethane, ethylene vinyl acetate, polyethylene or polypropylene, or blends thereof, of 40 to 60 durometer. An appropriate solvent is tetrahydrofuran.

A single self-supporting electrically conductive helical reinforcing element 11 is applied in successive convolutions engaging the outside of the hose wall formed by the strip 10. The direction and pitch of the helically applied element 11 is preferably the same as that of the strip 10 and the element 11 is located at the juncture between overlapping convolutions of the strip 10. The element 11 is of composite construction. A pair of spaced metal wires 12 and 13 are included which may be of solid or stranded 80 to 100% soft copper or aluminum. The diameter of the wires 12 and 13 may be from 0.015 to 0.030 inch. Each of the wires 12 and 13 is surrounded by a separate plastic insulation 14 and 15 which may be of semi-rigid polyvinylchloride of 80 to 90 durometer.

The insulated wires are passed through an extrusion die and embedded within an outer plastic sheath 16 of non-circular cross-section. The sheath 16 includes a substantially flat side facing inwardly and engaging the outer ply of the wall formed by the strip 10. The material of the sheath 16 may be the same as or at least compatible with the strip 10 so that the sheath can be readily bonded or fused in place. For aesthetic or coding purposes the color of the sheath 16 may contrast with that of the wall formed by the strip 10. The resulting corrugated profile of the hose is particularly resistant to wear and abrasion because the sheath 16 serves as a scuff strip which protects the wall formed by the strip 10. The bore of the hose is smooth and presents minimum resistance to air flow.

Figure 2:
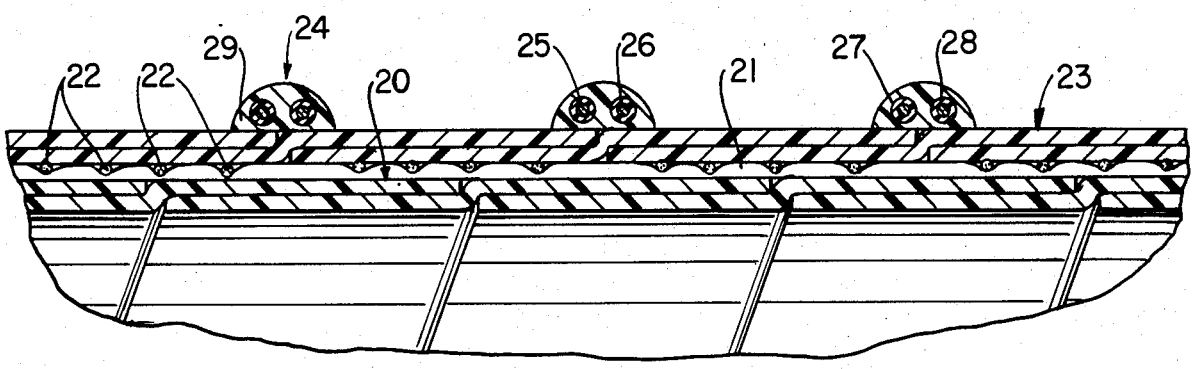
FIG. 2 is an enlarged fragmentary cross-section of a second embodiment of the hose of the invention including reinforcing cords.

Referring now to the embodiment of FIG. 2 an inner strip 20 is first wrapped about itself with helical convolutions overlapping and fused or bonded much in the manner of the strip 10. A plurality of longitudinal cords 21 are applied about the inner ply formed by the strip 20. They may be of polyester of approximately 1100 denier. They are uniformly spaced about the circumference of the hose and are typically from 9 to 36 in number depending upon the size of the hose. They may be precisely parallel to the axis of the hose or applied at a very slight angle, but in any event are at least substantially longitudinal. It is their purpose to strengthen the hose from being stretched to the point of damaging the plastic wall. To hold the longitudinal cords 21 in place against the inner ply formed by the strip 20, four helical cords 22 are applied, two to each side of the juncture between the edges of the convolutions of the strip 20. The composition and size of the cords 22 may be the same as those of the cords 21.

A second strip 23 is helically applied about the cords 21 and 22 and the first strip 20 with overlapping convolutions fused or bonded together. The turns of the second strip 23 are offset from those of the first strip 20 as shown in FIG. 2.

Applied about the outer ply of the hose wall formed by the second strip 23 is an electrically conductive helical reinforcing element 24 similar in materials and form to the element 11 of the embodiment of FIG. 1. It includes a pair of wires 25 and 26 each surrounded by respective insulation layers 27 and 28 all embedded within a sheath 29. As in the previous embodiment the sheath 29 is of non-circular cross-section and has a flat side facing inwardly and engaging the outer ply of the hose wall formed by the second strip 23. The element 24 is of the same pitch and direction as the strips 20 and 23 and is applied over the juncture between adjoining convolutions of the strip 23.

The scope of the invention is not to be limited to the specific embodiments described above but rather to the following claims.

I claim:

1. A helically fabricated electrically conductive flexible hose comprising (a) at least one plastic strip wrapped helically with successive convolutions overlapping and forming a flexible hose wall of at least one ply, and (b) at least one self-supporting electrically conductive helical reinforcing element forming the outermost element of the hose concentric with and engaging the outside of said wall and comprising i. at least two spaced inner metal wires, and ii. an outer plastic sheath of non-circular cross-section enclosing said wires and having a substantially flat side facing inwardly and engaging the outer ply of said wall, iii. the plastic sheath being bonded to the plastic wall.

2. A helically fabricated electrically conductive flexible hose according to claim 1 wherein a separate plastic insulation layer surrounds each metal wire within said plastic sheath.

3. A helically fabricated electrically conductive electrical hose according to claim 1 which includes a plurality of substantially longitudinal reinforcing cords circumferentially spaced about the hose wall and helical reinforcing cords wrapped about the hose wall, both the longitudinal and helical cords being inwardly of the helical reinforcing element.

4. A helically fabricated electrically conductive flexible hose comprising (a) a first plastic strip wrapped helically with successive convolutions overlapping and forming an inner ply of a flexible hose wall, (b) a plurality of longitudinal reinforcing cords circumferentially spaced about the inner ply of the hose wall, (c) a plurality of helical reinforcing cords wrapped about the inner ply of the hose wall over the longitudinal reinforcing cords, (d) a second plastic strip wrapped helically with successive convolutions overlapping and forming an outer ply of the flexible hose wall, and (e) a single self-supporting electrically conductive helical reinforcing element forming the outermost element of the hose concentric with and engaging the outer ply of the hose wall and comprising i. a pair of spaced inner metal wires, and ii. an outer plastic sheath of non-circular cross-section enclosing said wires and having a substantially flat side facing inwardly and engaging the outer ply of said wall, iii. the plastic sheath being bonded to the plastic wall.

5. A helically fabricated electrically conductive flexible hose according to claim 4 wherein a separate plastic insulation layer surrounds each metal wire within said plastic sheath.

* * * * *